US008042519B2

(12) United States Patent
Fulton et al.

(10) Patent No.: US 8,042,519 B2
(45) Date of Patent: Oct. 25, 2011

(54) COMMON RAIL FUEL SYSTEM WITH INTEGRATED DIVERTER

(75) Inventors: Brien Lloyd Fulton, West Bloomfield, MI (US); Anthony William Hudson, Highland, MI (US); Adam John Gryglak, Birmingham, MI (US); Kenneth G Pumford, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 26 days.

(21) Appl. No.: 12/533,274

(22) Filed: Jul. 31, 2009

(65) Prior Publication Data

US 2011/0023818 A1 Feb. 3, 2011

(51) Int. Cl.
*F02B 17/00* (2006.01)
*F02M 69/46* (2006.01)

(52) U.S. Cl. ..... 123/456; 123/446; 123/468; 123/510; 123/511; 123/541

(58) Field of Classification Search ..... 123/294–305, 123/447, 456, 495, 506, 509, 446, 457–459, 123/468–470, 510, 511, 541; 701/104–105
See application file for complete search history.

(56) References Cited

U.S. PATENT DOCUMENTS

| | | | | |
|---|---|---|---|---|
| 4,751,904 | A * | 6/1988 | Hudson, Jr. | 123/470 |
| 6,234,128 | B1 | 5/2001 | Reuss | |
| 6,505,608 | B2 * | 1/2003 | Hiraku et al. | 123/458 |
| 6,609,502 | B1 | 8/2003 | Frank | |
| 7,650,876 | B2 * | 1/2010 | Liedtke et al. | 123/509 |
| 7,669,570 | B2 * | 3/2010 | Hubl et al. | 123/179.9 |
| 7,712,452 | B2 * | 5/2010 | Matas et al. | 123/456 |
| 2004/0007212 | A1 * | 1/2004 | Kato | 123/494 |
| 2004/0194761 | A1 | 10/2004 | Ando et al. | |
| 2005/0109323 | A1 * | 5/2005 | Zdroik et al. | 123/456 |
| 2006/0120880 | A1 | 6/2006 | Shafer et al. | |
| 2006/0254563 | A1 * | 11/2006 | Keegan et al. | 123/456 |
| 2009/0276141 | A1 * | 11/2009 | Surnilla et al. | 701/103 |

FOREIGN PATENT DOCUMENTS

| | | | |
|---|---|---|---|
| EP | 1126161 | A1 | 8/2001 |
| EP | 1126161 | A1 | 8/2008 |
| GB | 2332241 | A | 6/1999 |

* cited by examiner

*Primary Examiner* — Willis Wolfe, Jr.
*Assistant Examiner* — Johnny Hoang
(74) *Attorney, Agent, or Firm* — Julia Voutryas; Brooks Kushman P.C.

(57) ABSTRACT

An internal combustion engine includes a fuel system having a first fuel rail with an integrated diverter portion coupled to a high-pressure pump and separated from a common rail portion by a flow restriction device. The first fuel rail includes a pressure sensor coupled to the diverter portion at one end and a control valve coupled to the common rail portion at the other end of the same fuel rail. In V-engine embodiments, a second fuel rail communicates with the integrated diverter portion of the first fuel rail. In one embodiment, components including the first and second fuel rails, a pressure sensor, and a pressure or volume control valve are externally mounted outside the engine valve cover.

17 Claims, 5 Drawing Sheets

QWC_tIPII1Mi1Cor_mp

COMMON RAIL FUEL SYSTEM WITH INTEGRATED DIVERTER

BACKGROUND

1. Technical Field

The present disclosure relates to multiple-cylinder internal combustion engines having a high-pressure common rail fuel system.

2. Background Art

High pressure common rail fuel systems typically include a high pressure fuel pump that delivers fuel to a fuel rail associated with a group of cylinders. The primary purpose of the fuel rail is to maintain sufficient fuel at the required pressure for injection while distributing fuel to the injectors, which all share fuel in the common rail. The rail volume acts as an accumulator in the fuel system and dampens pressure fluctuations from the pump and fuel injection cycles to maintain nearly constant pressure at the fuel injector nozzle.

Fuel system designs can be quite complex and are dependent upon a variety of considerations including connections or fittings to the fuel pump and injectors, connection points for the pressure sensor and regulator, and appropriate sizing to function as an accumulator. In "V" configuration engines, the high pressure fuel pump is often connected to both left and right common rails with each fuel rail associated with a corresponding cylinder bank. A pressure sensor and a pressure or volume control valve are used for closed loop feedback control of the rail pressure in response to commands from an engine or vehicle controller.

When the fuel injectors are actuated to inject fuel into the cylinder, a pressure wave travels from the injector inlet back through the high pressure lines or pipes to the associated fuel rail. This pressure wave may adversely affect the pressure control as well as the accuracy of the quantity of fuel delivered in a subsequent injection for the same cylinder for multiple injections per combustion cycle, and/or for subsequent cylinders in the firing order. Variations in fuel injection quantity and/or timing make it difficult to achieve desired emissions and performance goals. The high accuracy and small tolerances in injection quantity may require an appropriate volume in the fuel system to reduce pressure impulses from the high pressure fuel pump.

Package requirements have also become increasingly important as components are added and/or sized for increased performance, reliability, durability, and fuel economy while reducing emissions over the lifetime of the engine. Particularly for V-configuration diesel engines having a common rail system, multiple rails, fuel lines and connections present challenges for robustness to leaks while maintaining manufacturability.

SUMMARY

An internal combustion engine includes a fuel system having a first fuel rail with an integrated diverter portion coupled to a high-pressure pump and separated from a common rail portion by a flow restriction device. The first fuel rail includes a pressure sensor coupled to the diverter portion at one end and a control valve coupled to the common rail portion at the other end of the same fuel rail. In one V-engine embodiment, a second fuel rail communicates with the integrated diverter portion of the first fuel rail. In one embodiment, components including the first and second fuel rails, a pressure sensor, and a pressure or volume control valve are externally mounted outside the engine valve cover.

A number of advantages are associated with an engine according to the present disclosure. For example, on V-engine embodiments, the package of engine components can be optimized by using a rail on one side or bank of the "V" that has an integral diverter included in the rail volume and uses the existing threaded ends to mount a pressure (or volume) control valve and pressure sensor on a single rail. Mounting the control valve (pressure or volume) and rail pressure sensor on the combined diverter/common rail reduces the number of fuel lines (high and low pressure), number of connections, and fuel line length of the system. Fuel systems according to the present disclosure also reduce the number of fuel lines running by hot engine components and provide engine designers greater flexibility in packaging components on either side of a V-engine by decreasing the space required by the other (non-diverter) fuel rail.

Various embodiments of the present disclosure also reduce manufacturing complexity by reducing the number of fuel lines and connections in the engine and fuel system. In addition, embodiments of the present disclosure reduce the number of component interfaces by using existing threaded holes on the integrated diverter fuel rail as a mounting location for both the pressure/volume control valve and the fuel rail pressure sensor. Integration and coaxial alignment of the diverter portion and common rail portion of the fuel rail further reduces manufacturing complexity and machining operations. Reducing the number of fuel lines and connections also reduces the opportunity for leaks.

The above advantages and other advantages and features of associated with the present disclosure will be readily apparent from the following detailed description of the preferred embodiments when taken in connection with the accompanying drawings.

DETAILED DESCRIPTION

Figure 1:
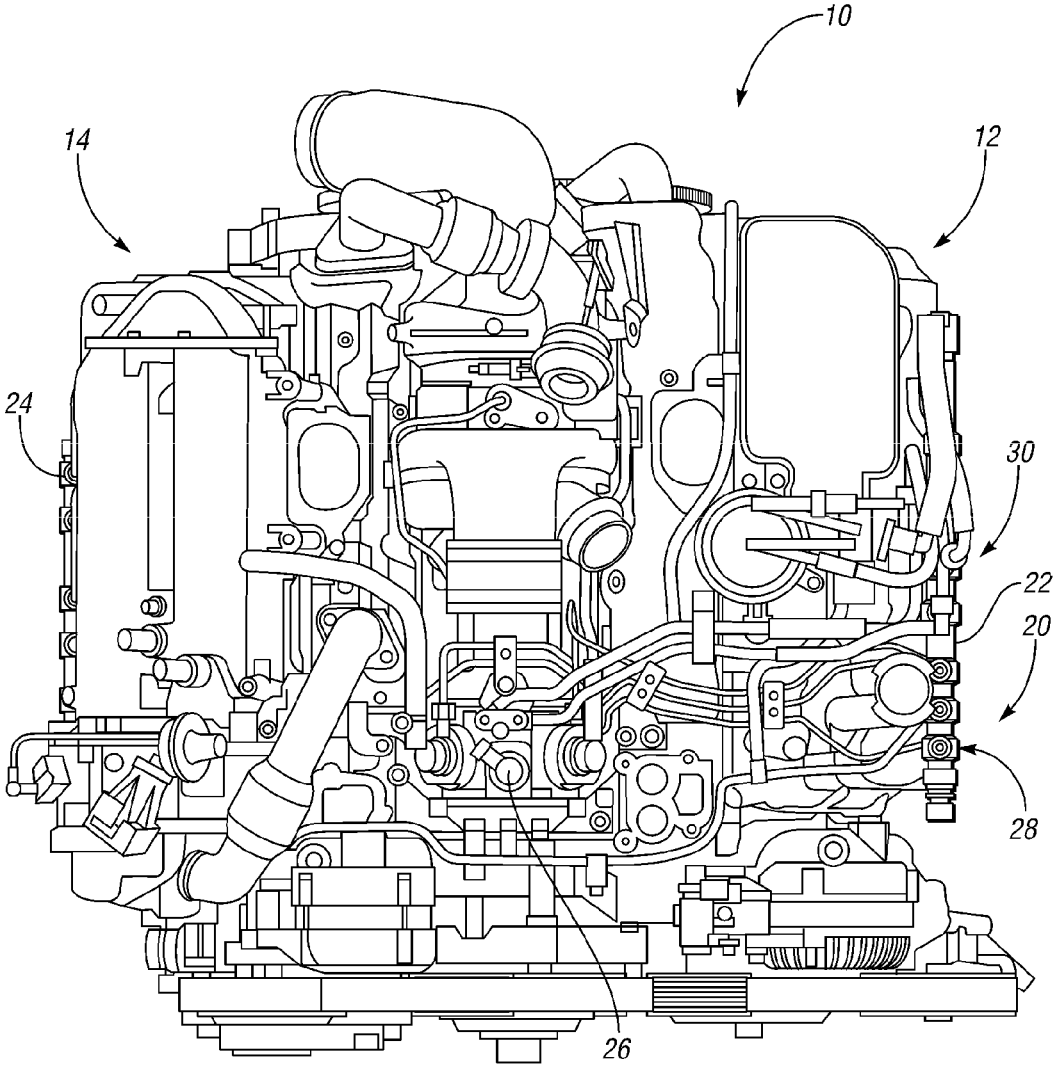
FIG. 1 is a top view of an engine with some upper components removed to illustrate a fuel system according to one embodiment of the present disclosure.

As those of ordinary skill in the art will understand, various features illustrated and described with reference to any one of the Figures may be combined with features illustrated in one or more other Figures to produce embodiments that are not explicitly illustrated or described. The combinations of features illustrated provide representative embodiments for typical applications. However, various combinations and modifications of the features consistent with the teachings of this disclosure may be desired for particular applications or implementations.

Referring now to FIGS. 1-4, a representative embodiment of an internal combustion engine 10 having a common rail fuel system 20 according to the present disclosure is shown. In the embodiment illustrated, engine 10 is a multiple cylinder, diesel fuel, compression-ignition engine having a first bank of four cylinders 12 and a second bank of four cylinders 14 arranged in a 90-degree "V" configuration. Those of ordinary skill in the art will recognize that the teachings of the present disclosure are generally independent of the particular fuel, engine configuration, or combustion technology and may be used in a variety of other applications having different fuel, different number of cylinders, and/or different cylinder configurations, for example.

Fuel system 20 includes a first fuel rail 22 associated with first cylinder bank 12 and a second fuel rail 24 associated with second cylinder bank 14. As illustrated and described in greater detail herein, first fuel rail 22 includes an integrated diverter portion 28 coupled to a high-pressure fuel pump 26, which is mounted in valley 16 (best illustrated in FIG. 4) between cylinder banks 12, 14 near the front of the engine when installed longitudinally in a vehicle. Mounting of fuel pump 26 in valley 16 toward the front of the engine generally forward of the exhaust manifold provides advantages in heat management while protecting fuel system 20 in the event of a vehicle crash.

First fuel rail 22 includes a common rail portion 30 coaxially aligned with and separated from diverter portion 28 by an internal flow restricting device 32, which is implemented by a throttle or fixed orifice in one embodiment. Fuel rails 22, 24 are generally cylindrical and may be of forged and/or welded construction, for example. In one embodiment, fuel rail 22 is manufactured from a hot forged blank having a hole drilled longitudinally through diverter portion 28 and common rail portion to provide a desired fuel accumulator volume. Intersecting holes are drilled to provide ports for various pump supply, fuel injector, cross-over, and fuel return line connections. Flow restricting device 32 may be integrally formed within fuel rail 22, or may be inserted during assembly. Flow restricting device 32 reduces the effect of pressure pulsations within fuel system 20, particularly within fuel rails 22, 24.

First fuel rail 22 includes a fuel rail pressure sensor 40 coupled to an end of diverter portion 28 and a control valve 42 coupled to an end of common rail portion 30. In one embodiment, pressure sensor 40 has a sensor range of about 0-2200 bar for an operational fuel pressure range of between about 230-2000 bar. Pressure sensor 40 communicates a corresponding signal to an engine or vehicle controller (not shown) used for feedback control of the fuel pressure within fuel rails 22 and 24. The primary purpose of fuel rails 22, 24 is to maintain sufficient fuel at the required pressure for injection by a first plurality of injectors 52 associated with first fuel rail 22 and a second plurality of injectors 54 associated with second fuel rail 24. Because all the injectors share pressurized fuel distributed by the rail, this arrangement is generally referred to as a common rail fuel system. Diverter portion 28 and common rail portion 30 of rails 22, 24 provides a volume of fuel that functions as an accumulator in the fuel system and dampens pressure fluctuations from high pressure pump 26 and fuel injection cycles of fuel injectors 52, 54 to maintain nearly constant pressure at the fuel injector nozzle, indicated generally at 56.

In the illustrated embodiment, control valve 42 is mounted at the end of common rail portion 30 of first fuel rail 22. Control valve 42 may be implemented by a pressure control device or a volume control device. In one embodiment, control valve 42 is a pressure regulator that controls rail pressure in fuel rails 22, 24 in response to a pressure command received from a microprocessor based engine, vehicle, or fuel system controller. Control valve 42 controls rail pressure with first and second fuel rails 22, 24 by controlling or modulating the quantity of fuel exiting the common rail portion 30 through fuel rail return port 58 and returning to fuel tank 70. Control valve 42 closes to reduce fuel flow to return line 60 to increase rail pressure, and opens to increase fuel flow to return line 60 to decrease rail pressure. High-pressure pump 26 may also include a pressure regulator or control valve 62 to control pump outlet pressure. Pressurization of the fuel and close proximity to heated engine components may require the fuel to be cooled before being returned through the fuel system. As such, high-pressure pump return flow through line 64 is combined with flow from fuel rail return line 60 and returned through low-pressure line 66 through a fuel cooler 68 to fuel tank 70. Fuel cooler 68 is a heat exchanger with a low temperature coolant loop 72 used to lower the fuel temperature before being returned to fuel tank 70. After combining with tank fuel, the fuel is pumped by low-pressure pump 76 through a coarse filter 74 and a fine filter 78 to high-pressure pump 26. A high-pressure pump inlet pressure sensor 80 and temperature sensor 82 may be provided to monitor parameters of the fuel supplied to high-pressure pump 26.

High-pressure pump 26 may be driven directly or indirectly by rotation of crankshaft 100 using gears, chains, belts, etc. such that the pump speed is directly proportional to engine speed. Therefore, the power required to drive pump 26 is proportional to the fuel rail pressure and pump speed. To improve pump efficiency, pump 26 may have the ability to disable one or more pumping elements to reduce total fuel delivery and limit excess fuel delivered to fuel rails 22, 24. In the illustrated embodiment, pump 26 includes two high-pressure outlets 102, 104 that are both coupled to diverter portion 28 of first fuel rail 22. Pump rotation is synchronized with crankshaft rotation so the pump stroke occurs during an injection stroke to improve mean pressure delivery and to improve fuel quantity accuracy from injection to injection (shot to shot) and injector to injector. Those of ordinary skill in the art will recognize that a different number of high-pressure outlets may be provided depending on the particular dynamics of the fuel system. In the illustrated embodiment, pump 26 includes two high-pressure outlets 102, 104 to provide desired dynamic characteristics as generally illustrated and described with respect to FIG. 5.

High-pressure pump 26 maintains fuel pressure within fuel rails 22, 24 independent of the fuel injection quantity that fuel injectors 52, 54 deliver to corresponding cylinders. Fuel injectors 52, 54 control the fuel injection quantity and timing in response to corresponding signals from the engine controller. This allows each aspect of fuel delivery (quantity, timing, and pressure) to be independently controlled. Fuel injectors 52, 54 are generally either piezoelectric or solenoid actuated injectors. However, the present disclosure is independent of the particular injector technology used as previously described. Fuel system 20 is capable of multiple injections or shots of fuel in a single cylinder for a single combustion cycle to meet desired performance, fuel economy, NVH, and emissions goals. In one embodiment, six or more injections may be provided by injectors 52, 54 under some operating conditions.

Figure 2:
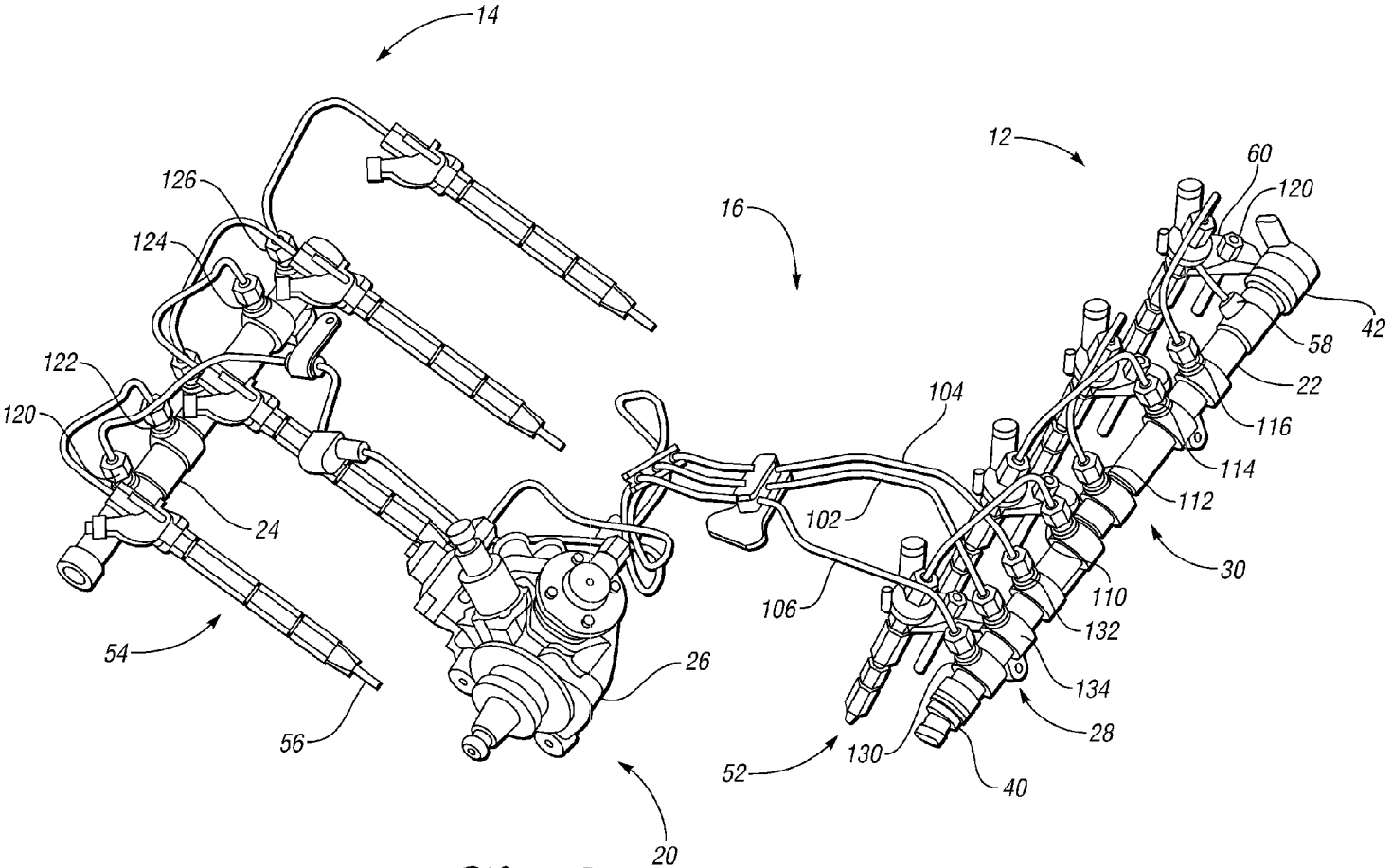
FIG. 2 illustrates an engine fuel system having an integrated diverter fuel rail for a V-engine embodiment.

As best illustrated in FIG. 2, each of the first plurality of fuel injectors 52 is coupled to a corresponding fuel injector port 110, 112, 114, and 116 defined in common rail portion 30 of first fuel rail 22 via a corresponding high-pressure fuel line. Similarly, each of the second plurality of fuel injectors 54 is coupled to a corresponding fuel injector port 120, 122, 124, 126 defined by second rail 24 via a corresponding high-pressure fuel line. Second fuel rail 24 is coupled to diverter portion 28 of first fuel rail 22 via crossover line 106 and crossover port 130 defined by fuel rail 22. In this embodiment, the high pressure outlets 102, 104 of high-pressure pump 26 are connected directly only to diverter portion 28 of first fuel rail 22, and not to second fuel rail 24.

Figure 4:
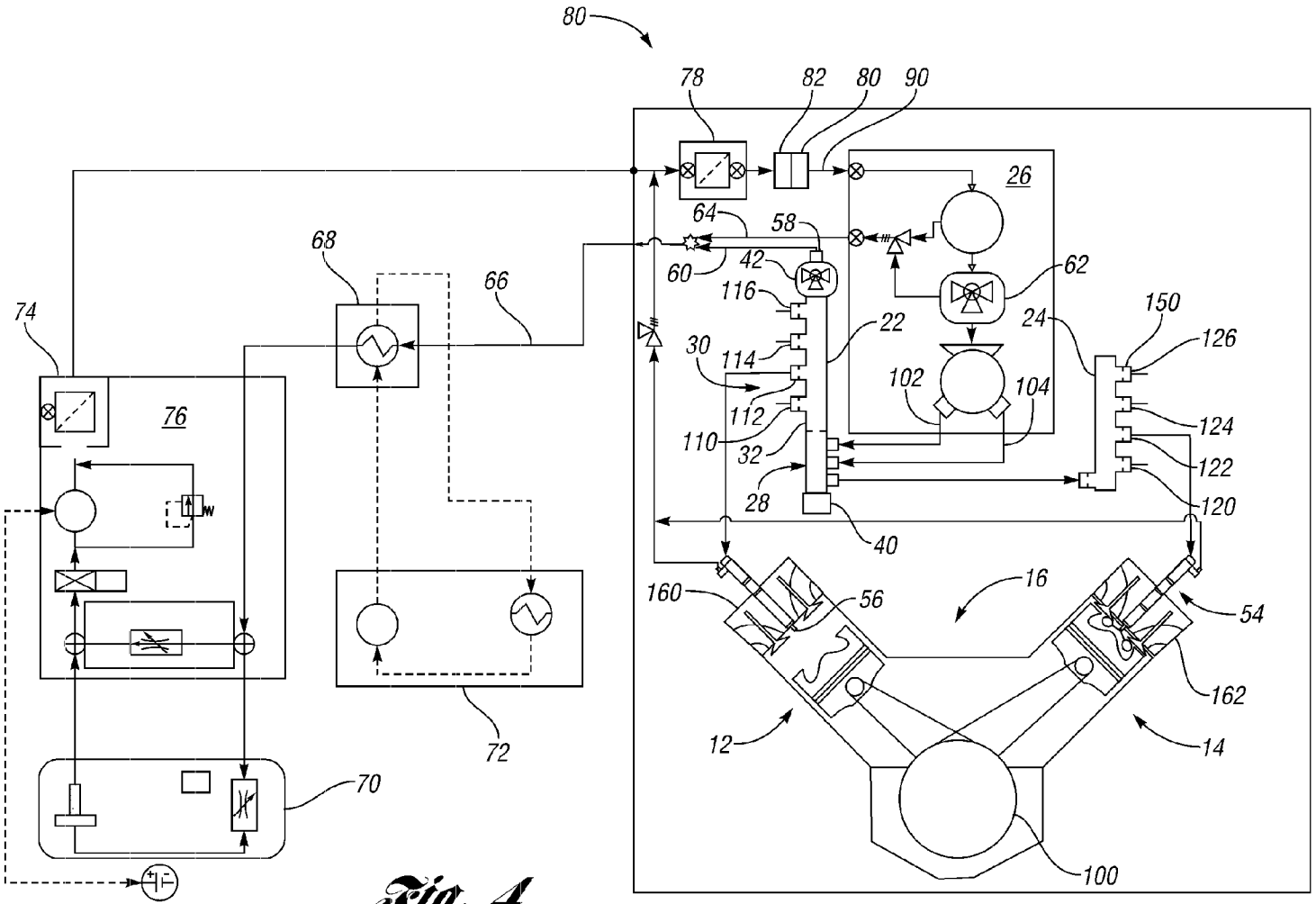
FIG. 4 is a schematic illustrating fuel system connections according to one embodiment of the present disclosure.

As best illustrated in FIG. 4, first fuel rail 22 may be manufactured from a generally cylindrical forged blank or pipe with a longitudinal hole or passageway drilled or formed from end to end so that diverter portion 28 and common rail portion 30 are coaxially aligned. Holes are drilled to create intersecting passages to the longitudinal or axial bore to define the various first and second high-pressure pump supply ports, fuel return port, injector ports, and crossover port. In the embodiment illustrated, first and second high-pressure pump ports 132, 134 and crossover port 130 are positioned within diverter portion 28, with crossover port 130 adjacent second pump port 134. Fuel rail return port 58 is positioned adjacent control valve 42 within common rail portion 28, and injector ports 110, 112, 114, and 116 are disposed between crossover port 130 and fuel rail return port 58.

The exterior of each port is threaded to facilitate coupling of a standard fuel line connector, such as described in the DIN ISO 2974 (SAE J1949) standard, for example. Each fuel injector port 110, 112, 114, 116 in fuel rail 22 and each fuel injector port 120, 122, 124, 126 in fuel rail 24 may contain an associated flow restricting device, generally represented by reference numeral 150. Similar to flow restricting device 32, flow restricting devices 150 may be implemented by a fixed orifice plug or throttle, for example. Flow restricting device 32 may be a different device and/or sized differently than flow restricting devices 150 depending on the particular application and implementation. The internal throttles reduce the impact of pressure waves between injectors and injections.

An internal combustion engine fuel system 20 according to the present disclosure provides better packaging flexibility in that first rail 22 integrates diverter portion 28 in addition to mounting pressure sensor 40 and control valve 42. As a result, second rail 24 is about 30% shorter and creates additional space for other engine components. In addition, mounting of fuel pump 26 in valley 16 generally forward of the exhaust manifold, in combination with the features of fuel rail 22, reduces the overall fuel line length of the low-pressure fuel system and reduces the number of fuel lines crossing over the exhaust manifold, which reduces fuel heating.

Figure 3:
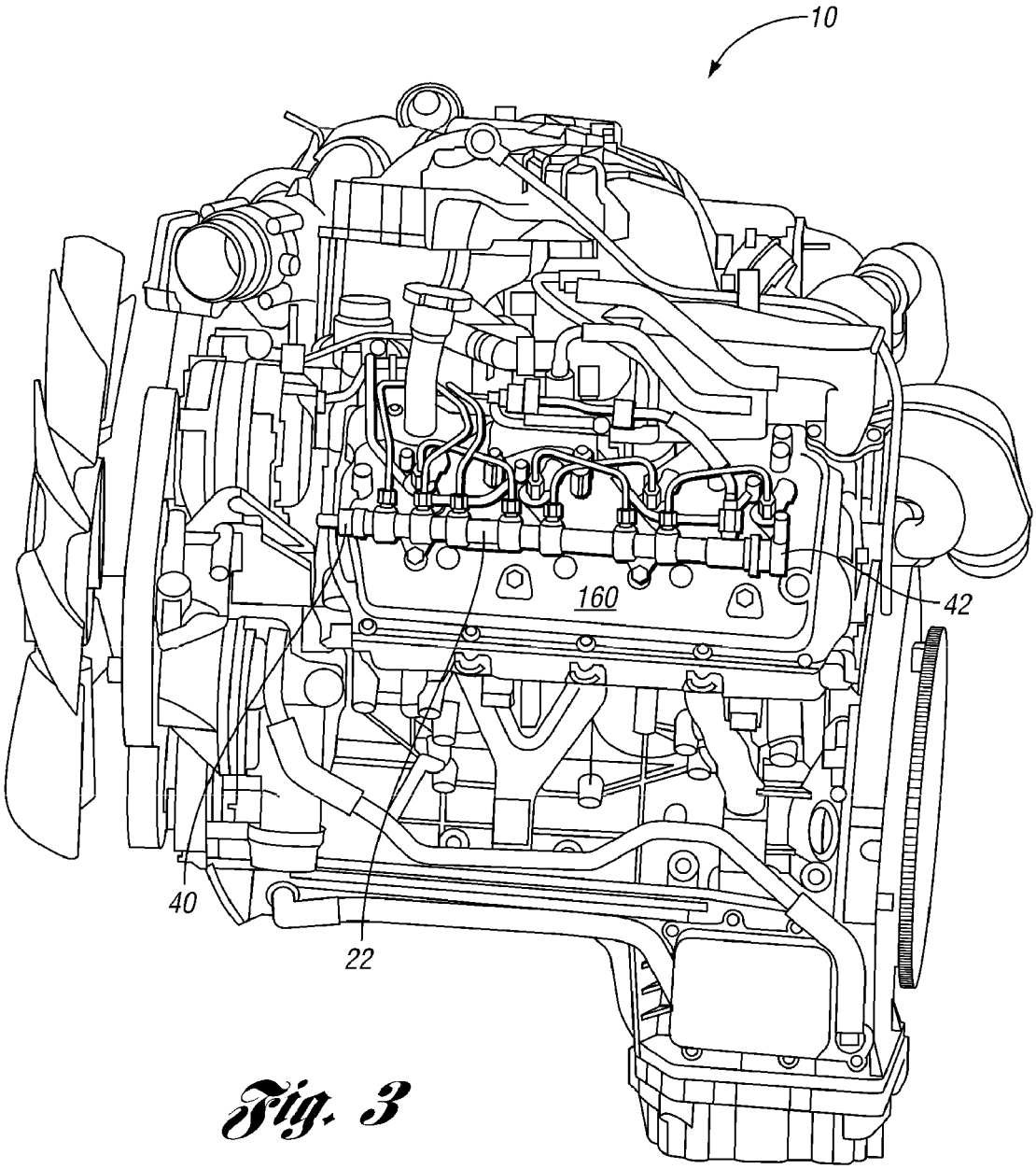
FIG. 3 is a side view illustrating external (dry) mounting of fuel system components according to one embodiment of the present disclosure

As best illustrated in FIGS. 3 and 4, fuel system 20 is designed for serviceability with first and second fuel rails 22, 24, high-pressure pump 26, pressure sensor 40, pressure control valve 42, and high-pressure fuel lines and interfaces/connectors located outside or externally relative to respective valve covers 160, 162. Similarly, injectors 52, 54 are held in place by clamps 170 with a single bolt extending through an associated valve cover 160, 162 into the cylinder head such that the injectors are easily accessible. In addition, various high-pressure components are located inboard of the outside edge of the engine to meet crash worthiness goals.

Figure 5:
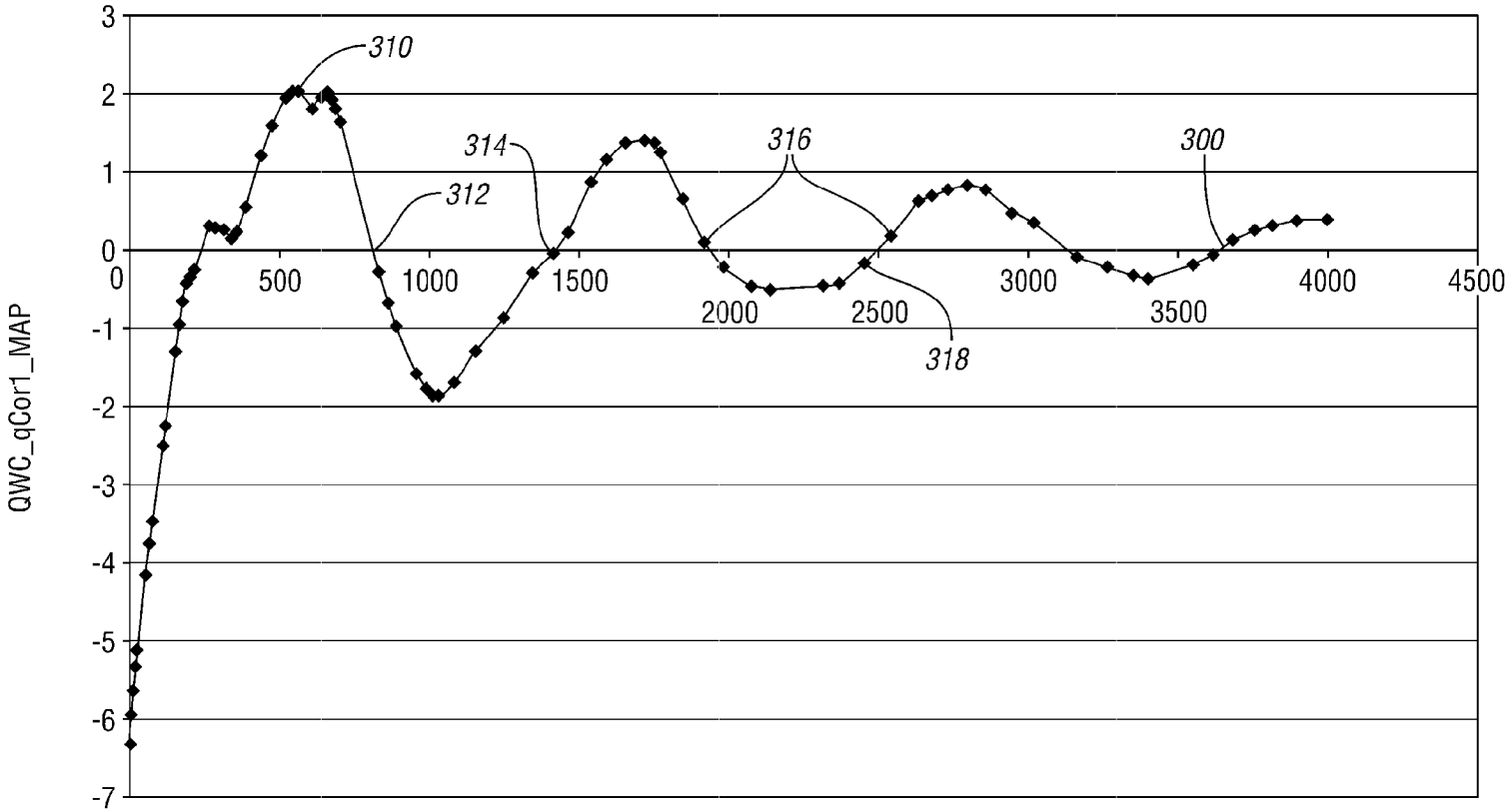
FIG. 5 is a graph illustrating high-pressure fuel line pressure pulsations associated with a fuel system according to the present disclosure.

FIG. 5 is a graph illustrating representative pressure pulsations within a high-pressure fuel pipe connecting an injector to a common rail in an internal combustion engine fuel system. The pressure wave 300 travels from the injector inlet back down the high pressure pipe to the fuel rail and back. This pressure wave affects the accuracy of the fuel quantity delivered, particularly for multiple injections. Once recognized, the effect of the pressure wave may be reduced or eliminated by appropriate corrections to the injector pulse width. The graph of FIG. 5 charts the dwell time between injections and associated performance attributes of the engine if appropriate pulse width compensation is not employed. For example, fuel injection peak at 310 is associated with the best fuel economy while 312 is the point for lowest hydrocarbon emissions. Similarly, 314 corresponds to lowest combustion noise, points 316 corresponds to lowest NOx production during combustion, and point 318 corresponds to lowest smoke production.

As such, embodiments of the present disclosure use the existing threaded ends of a integrated diverter fuel rail to mount a pressure (or volume) control valve and pressure sensor. Mounting the control valve (pressure or volume) and rail pressure sensor on the combined diverter/common rail reduces the number of fuel lines (high and low pressure), number of connections, and fuel line length of the system. Fuel systems according to the present disclosure also reduce the number of fuel lines running by hot engine components and provide engine designers greater flexibility in packaging components on either side of a V-engine by decreasing the space required by the other (non-diverter) fuel rail.

Various embodiments of the present disclosure also reduce manufacturing complexity by reducing the number of fuel lines and connections in the engine and fuel system. In addition, embodiments of the present disclosure reduce the number of component interfaces by using existing threaded holes on the integrated diverter fuel rail as a mounting location for both the pressure/volume control valve and the fuel rail pressure sensor. Integration and coaxial alignment of the diverter portion and common rail portion of the fuel rail further reduces manufacturing complexity and machining operations. Reducing the number of fuel lines and connections also reduces the opportunity for leaks.

While one or more embodiments have been illustrated and described, it is not intended that these embodiments illustrate and describe all possible embodiments within the scope of the claims. Rather, the words used in the specification are words of description rather than limitation, and various changes may be made without departing from the spirit and scope of the disclosure. While various embodiments may have been described as providing advantages or being preferred over other embodiments or prior art implementations with respect to one or more desired characteristics, as one skilled in the art is aware, one or more features or characteristics may be compromised to achieve desired overall system attributes, which depend on the specific application and implementation. These attributes include, but are not limited to: cost, strength, durability, life cycle cost, marketability, appearance, packaging, size, serviceability, weight, manufacturability, ease of assembly, etc. Embodiments described as less desirable than other embodiments or prior art implementations with respect to one or more characteristics are not outside the scope of the disclosure and may be desirable for particular applications.

What is claimed:

1. An internal combustion engine having a fuel system comprising:

a first fuel rail having an integrated diverter portion coupled to a high-pressure pump and separated from a common rail portion by a flow restriction device;

a pressure sensor coupled to the integrated diverter portion;

a control valve coupled to the common rail portion; and a second fuel rail in communication with the integrated diverter portion of the first fuel rail.

2. The engine of claim 1 further comprising:

a first plurality of fuel injectors coupled to the common rail portion; and a second plurality of fuel injectors coupled to the second fuel rail.

3. The engine of claim 1 further including a valve cover, wherein the first and second fuel rails, the pressure sensor, and the control valve are externally disposed outside the valve cover.

4. The engine of claim 1 wherein the integrated diverter portion and the common rail portion are coaxially aligned.

5. The engine of claim 1 wherein the high pressure pump is connected only to the integrated diverter portion of the first fuel rail and not to the second fuel rail.

6. The engine of claim 1 wherein the control valve comprises a pressure control valve.

7. The engine of claim 6 wherein the pressure control valve operates in response to a pressure command from an engine controller to control pressure within the first and second fuel rails by modulating quantity of fuel exiting the common rail portion and returning to a fuel tank.

8. The engine of claim 7 further comprising a fuel cooler disposed between the pressure control valve and the fuel tank.

9. The engine of claim 1 wherein all high-pressure outlets of the high-pressure pump are coupled to the integrated diverter portion of the first fuel rail.

10. The engine of claim 1 wherein the first fuel rail comprises a cylindrical pipe having a longitudinal passageway with intersecting passages including:

first and second high-pressure pump ports and a crossover port adjacent the second pump port within the integrated diverter portion;

a fuel rail return port adjacent the control valve within the common rail portion; and a plurality of injector ports disposed between the crossover port and the fuel rail return port.

11. A compression-ignition internal combustion engine having first and second banks of cylinders arranged in a V-configuration defining a valley between the cylinder banks, the engine comprising:

a high-pressure fuel pump having at least two high-pressure outlets and mounted in the valley;

a first fuel rail associated with the first cylinder bank, the first fuel rail having a diverter coupled to the high-pressure outlets and separated from a common rail by a throttle, the common rail including a fuel return port;

a pressure sensor coupled to an end of the diverter;

a control valve coupled to an end of the common rail and controlling fuel flow through the return port;

a first plurality of fuel injectors coupled to the common rail through a plurality of injector ports, each injector port having a throttle;

a second fuel rail associated with the second cylinder bank, the second fuel rail being shorter than the first fuel rail and coupled directly to the diverter; and a second plurality of fuel injectors coupled to the second fuel rail through corresponding injector ports, each injector port having a throttle, wherein the first and second fuel rails are mounted externally relative to associated first and second valve covers.

12. The engine of claim 11 wherein the control valve comprises a pressure control valve.

13. The engine of claim 11 further comprising a fuel cooler coupled to the return port.

14. The engine of claim 11 further comprising a low-pressure fuel pump coupled to an inlet of the high-pressure pump.

15. An internal combustion engine fuel system comprising:

a fuel rail having an integral diverter coaxially aligned with and separated from a common rail by a throttle, the diverter defining an inlet port and a crossover port and having an end adapted to receive a pressure sensor, the common rail defining a plurality of injector ports each having a throttle, a fuel return port, and an end adapted to receive a coaxially aligned pressure control valve.

16. The internal combustion engine fuel system of claim 15 wherein the diverter defines at least two inlet ports adapted for coupling to a high-pressure fuel pump.

17. The internal combustion engine fuel system of claim 15 wherein the fuel return port is disposed adjacent the end adapted to receive the pressure control valve.

* * * * *